United States Patent [19]

Willem

[11] 4,421,948

[45] Dec. 20, 1983

[54] LINE POST TYPE ELECTRIC INSULATOR

[75] Inventor: Michel Willem, Abrest, France

[73] Assignee: Societe Anonyme dite: Ceraver, Paris, France

[21] Appl. No.: 347,200

[22] Filed: Feb. 9, 1982

[30] Foreign Application Priority Data

Feb. 13, 1981 [FR] France ..... 81 02890

[51] Int. Cl.[3] ..... H01B 17/16

[52] U.S. Cl. ..... 174/158 R; 174/177; 174/189

[58] Field of Search ..... 174/140 S, 158 R, 163 R, 174/168, 169, 176, 177, 178, 179, 186, 188, 189, 194, 195, 196, 209; 403/265, 267, 268

[56] References Cited

U.S. PATENT DOCUMENTS

| | | | |
|---|---|---|---|
| 3,898,372 | 8/1975 | Kalb | 174/179 |
| 4,316,054 | 2/1982 | Willem | 174/179 X |

FOREIGN PATENT DOCUMENTS

| | | | |
|---|---|---|---|
| 2419571 | 10/1979 | France | 174/179 |
| 2445596 | 7/1980 | France | 174/179 |
| 491474 | 7/1970 | Switzerland | 174/179 |

*Primary Examiner*—Laramie E. Askin

*Attorney, Agent, or Firm*—Kenyon & Kenyon

[57] ABSTRACT

An electric insulator which includes a rod (2) made of glass fibres and resin, one end of said rod being received in a fitting (1) made fast to a post (20). To improve the mechanical strength of the rod (2) in the anchoring means, a fitting (1) with a double cone recess is provided and the end of the rod has one or two grooves machined therein and is embedded in the recess in an organic substance (16). The grooves are formed only through the lower portion of the rod where the fibres are subjected to compression forces.

4 Claims, 3 Drawing Figures

LINE POST TYPE ELECTRIC INSULATOR

The present invention relates to an electric insulator of the line post type and in particular to fixing it to a post.

BACKGROUND OF THE INVENTION

In outline, such an insulator consists of a glass fibre and resin rod sheathed with an elastomer casing which is optionally provided with fins also made of elastomer e.g. EPDM (Ethylene-Propylene-Diene Monomer). One of its ends is fixed to a post via a fitting and its other end has another fitting to which is attached a clip for a conductor.

The rod as a whole and in particular its end which is anchored in the fitting fixed to the post is subjected to high mechanical stresses. It tends to sag under the weight of the conductor; the upper fibres are in reaction while the lower fibres are in compression.

To improve anchoring of the end of the rod, it has already been recommended to machine said end to impart thereto the shape of a single or a double cone; however, it has been observed that under high mechanical loading, racks appear between the fibres in parallel to the fibres.

Preferred embodiments of the present invention mitigate these drawbacks and produce a line post type insulator fixed to a post by anchoring means which impart greater mechanical strength to the rod.

SUMMARY OF THE INVENTION

The present invention provides an electric line post type insulator which comprises a rod made of glass fibres and resin covered with an insulating coating, one end of said rod being held fast in a fitting designed to be fixed on a post, wherein said fitting has a recess substantially in the shape of a double cone for receiving said end of the rod and embedding it in an organic substance, said end having at least one groove to provide positive anchoring, said groove being formed only through the lower portion of the rod where the fibres are subjected to compression forces.

The expression "lower" corresponds to the normal operating disposition of the rod.

Preferably, said groove is situated substantially in a plane perpendicular to the axis of the rod and the nearer it is to the neutral fibres of the rod, the shallower it is.

Said groove has flat portions to prevent rotation of the rod.

BRIEF DESCRIPTION OF THE DRAWINGS

An embodiment of the invention is described by way of example with reference to the accompanying drawing in which.

MORE DETAILED DESCRIPTION

Figure 1:
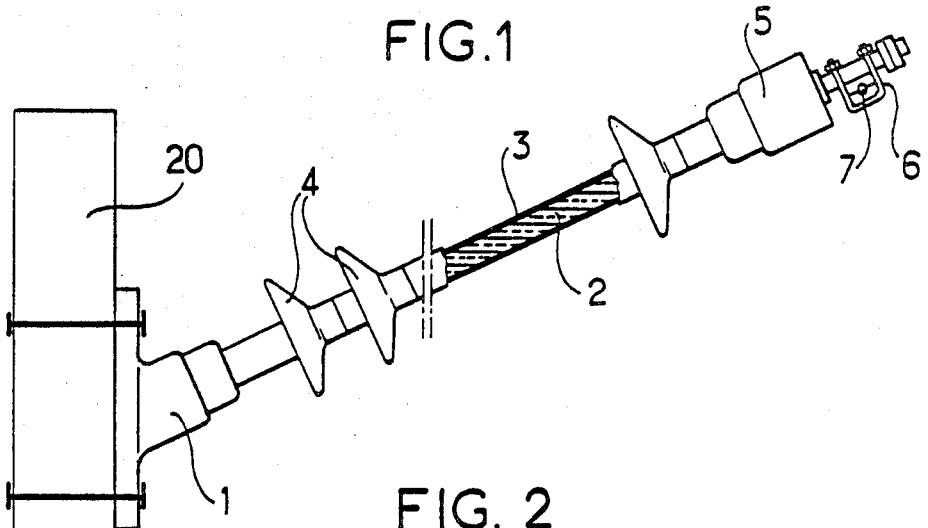
FIG. 1 is a diagrammatic partially cut view of a line post type insulator.

The insulator illustrated in FIG. 1 is fixed on a post 20 by means of a fitting 1. It has a rod 2 made of glass fibres and resin sheathed with an elastomer casing 3 on which fins 4, also made of an elastomer, are fitted. A fitting 5 to which a clip 6 for a conductor 7 is attached is fixed to the other end of the rod 2.

At the point where it is anchored in the fitting 1, the rod 2 is carefully degreased and may be covered with a coat of primer.

The internal shape of the anchoring fitting 1 is constituted by two double cones one of which, referenced 8, is close to the inner end of the anchoring means, the other, referenced 9, being close to the outlet thereof; the slopes of the generating lines which constitute a double cone such as 8 are approximately 10% relative to the axis of the anchoring means in the case of generating lines 10 and 20% in the case of generating lines 11, these generating lines being connected together by a suitable radius 12, e.g. about 5 mm.

Figure 2:
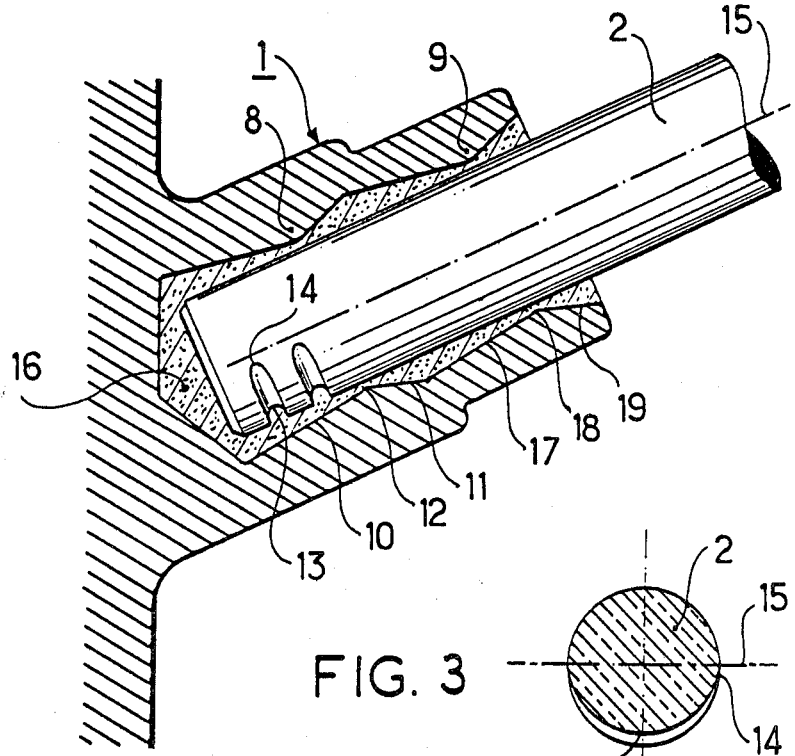
FIG. 2 is a cross-section through the end of the rod in a fitting in accordance with the invention.
Figure 3:
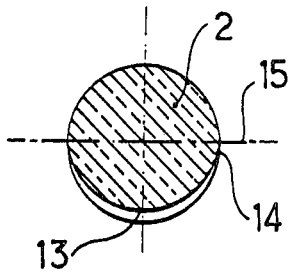
FIG. 3 is a cross-section of the rod where it has an anchoring groove.

One or two grooves are machined in the end of the rod associated with the anchoring end exclusively in the lower side of the rod, i.e. in the fibres subject to compression. Said grooves are shaped, for example, as illustrated in FIGS. 2 and 3, the depth of the grooves tapers down from about 3 mm in the vicinity of fibres 13 which are the lowest, to 0 mm in the vicinity of fibres 14 which are situated near the plane of the neutral fibres 15 (see FIG. 3).

The figures do not show the flat portions which could be provided in the bottoms of the grooves to prevent rotation.

Such machining aims to define positive embedding of the rod 2 in the fitting 1 by means of an organic bedding substance 16.

Mechanically, the anchoring means behaves as explained hereinafter.

Since the adherence of the embedding substance 16 to the rod 2 is greater than the adherence of the embedding substance to the inside of the fitting, traction on the rod causes double conical jamming of the embedding substance and therefore of the rod. This imparts e.g. to a rod 63 mm in diameter a very high strength which exceeds 10 tonnes (metric tons), for example.

Under the effect of bending forces, the lower portion of the rod 2 is urged, in the neighbourhood of its embedded end, to slide relative to the fitting 1. It is prevented from doing so by the efffect of conical jamming developed mainly by end slope 10 of the double cone 8 of the fitting and also by a parallel slope 17 of the double cone 9 of said fitting.

When the rod is urged to bend, it bears mainly at the outlet of the anchoring means on apex 18 of the double cone 9. The stresses which result therefrom are distributed along the rod due to the slope 19 of the double cone 9; this avoids premature destruction of the rod by transversal shearing of the fibres at the outlet of the anchoring means.

The above-mentioned conical jamming effects cause transversal compression stresses in the rod which tend to prevent the neutral fibres from being torn apart lengthwise, the stresses which cause such tearing (by shearing of the resin) being the greatest along the planes of the neutral fibres.

The fact that the rod is not machined on the side nearest the stretched fibres proves favourable to preventing tearing apart at the fibre surfaces which usually occurs in the notches due to damage to the fibres and to concentration of the stresses in the neighbourhood of said notches.

It should also be observed that the stresses developed in the embedded portion of the rod and which are necessary to hold the rod in the anchoring fitting remain low as long as the forces imposed on the insulator are low. This is favourable to prevent flow of the embedding substance 16 and of the rod.

Of course, the invention is not limited to the embodiment which has just been described. Without going beyond the scope of the invention, in particular the double cones can be replaced by any equivalent shape and it is possible to use only one double cone or more than two double cones.

I claim:

1. An electric line post type insulator which comprises a rod made of glass fibres and resin covered with an insulating coating, one end of said rod being held fast in a fitting designed to be fixed on a post, wherein said fitting has a recess substantially in the shape of a double cone for receiving said end of the rod and embedding it in an organic substance, said end having at least one groove to provide positive anchoring, said groove being formed only through the lower portion of the rod where the fibres are subjected to compression forces.

2. An insulator according to claim 1, wherein said recess has a plurality of consecutive double cones.

3. An insulator according to claim 1, wherein said groove is situated substantially in a plane perpendicular to the axis of the rod and wherein the nearer it is to the neutral fibres of the rod, the shallower it is.

4. An insulator according to claim 1, wherein said groove has flat portions to prevent rotation of the rod.

* * * * *